US010035111B2

(12) United States Patent
Jarrousse et al.

(10) Patent No.: US 10,035,111 B2
(45) Date of Patent: Jul. 31, 2018

(54) METHOD AND INSTALLATION FOR PREPARING A DRINK, PARTICULARLY WINE, FOR TASTING

(71) Applicant: 10-VINS, Nantes (FR)

(72) Inventors: Thibaut Jarrousse, Nantes (FR); Luis Da Silva, Reze (FR); Jerome Pasquet, Nantes (FR)

(73) Assignee: 10-VINS, Nantes (FR)

( * ) Notice: Subject to any disclaimer, the term of this patent is extended or adjusted under 35 U.S.C. 154(b) by 177 days.

(21) Appl. No.: 14/900,754

(22) PCT Filed: Jul. 1, 2014

(86) PCT No.: PCT/FR2014/051679
§ 371 (c)(1),
(2) Date: Dec. 22, 2015

(87) PCT Pub. No.: WO2015/001243
PCT Pub. Date: Jan. 8, 2015

(65) Prior Publication Data

US 2016/0175783 A1 Jun. 23, 2016

(30) Foreign Application Priority Data

Jul. 3, 2013 (FR) ..... 13 56492

(51) Int. Cl.
*B01F 3/04* (2006.01)
*B01F 3/20* (2006.01)
(Continued)

(52) U.S. Cl.
CPC ..... *B01F 3/04808* (2013.01); *B01F 3/04106* (2013.01); *B01F 3/04503* (2013.01);
(Continued)

(58) Field of Classification Search
CPC .... A23L 2/00; B01F 3/04099; B01F 3/04106; B01F 3/04787; B01F 3/04815
(Continued)

(56) References Cited

U.S. PATENT DOCUMENTS 4,453,503 A 6/1984 Freeburn
4,723,688 A 2/1988 Munoz
(Continued)

OTHER PUBLICATIONS

Search Report dated 2015.
(Continued)

*Primary Examiner* — Robert A Hopkins
(74) *Attorney, Agent, or Firm* — Ipsilon USA, LLP

(57) ABSTRACT

The invention relates to an installation (1) for preparing a beverage, in particular a wine, for tasting, said installation (1) including a liquid flow pipe (2) equipped with at least one feed inlet (3) for feeding in beverage for preparation, and a with at least one dispensing outlet (4) for dispensing the prepared beverage. Said pipe (2) is provided with Peltier-effect cooling and/or heating means (5) and with aeration means (6) for cooling and/or heating and for aerating the inside of the pipe (2), the two means being disposed along the pipe over different segments of said pipe that are referred to respectively as "the cooling and/or heating segment" (7) and as "the aeration segment" (8).

14 Claims, 5 Drawing Sheets

(51) Int. Cl.

| | |
|---|---|
| ***B01F 5/04*** | (2006.01) |
| ***B01F 5/10*** | (2006.01) |
| ***B67D 3/00*** | (2006.01) |
| ***B67D 1/00*** | (2006.01) |
| ***B67D 1/08*** | (2006.01) |
| ***B01F 15/00*** | (2006.01) |
| ***B01F 15/06*** | (2006.01) |
| *B67D 1/10* | (2006.01) |

(52) U.S. Cl.
CPC ..... *B01F 3/04787* (2013.01); *B01F 3/04815* (2013.01); *B01F 3/2014* (2013.01); *B01F 3/2078* (2013.01); *B01F 5/0413* (2013.01); *B01F 5/0428* (2013.01); *B01F 5/10* (2013.01); *B01F 15/00396* (2013.01); *B01F 15/065* (2013.01); *B67D 1/0003* (2013.01); *B67D 1/0869* (2013.01); *B67D 1/0895* (2013.01); *B67D 3/0009* (2013.01); *B67D 3/0032* (2013.01); *B01F 2015/061* (2013.01); *B01F 2015/062* (2013.01); *B01F 2215/0072* (2013.01); *B67D 1/108* (2013.01); *B67D 3/0022* (2013.01); *B67D 2210/00099* (2013.01)

(58) Field of Classification Search
USPC ..... 261/72.1, 76, 77, 119.1; 99/323.1
See application file for complete search history.

(56) References Cited

U.S. PATENT DOCUMENTS

| | | | | |
|---|---|---|---|---|
| 4,829,771 | A | 5/1989 | Koslow et al. | |
| 5,421,159 | A | 6/1995 | Stokes | |
| 6,060,092 | A | 5/2000 | Oesterwind et al. | |
| 6,298,669 | B1 | 10/2001 | Maruyama et al. | |
| 6,547,103 | B1 | 4/2003 | Elliott | |
| 7,237,390 | B1 | 7/2007 | Nelson | |
| 7,380,584 | B2 | 6/2008 | Ippoushi et al. | |
| 7,841,387 | B2 | 11/2010 | Ippoushi et al. | |
| 8,011,536 | B2 | 9/2011 | Witschke et al. | |
| D686,863 | S | 7/2013 | Chen et al. | |
| 8,820,094 | B1 | 9/2014 | Casher | |
| 9,670,050 | B1 | 6/2017 | Casher | |
| 2005/0230414 | A1 | 10/2005 | Yoshida et al. | |
| 2014/0242241 | A1 | 8/2014 | Chen et al. | |
| 2016/0175785 | A1* | 6/2016 | Li ..... | A47J 31/00 366/163.2 |

OTHER PUBLICATIONS

"The Peltier Effect—"a cool technology" for thermal desorption," dated Nov. 4, 2011.

"Custom Fluval Edge with LED lights and TEC Cooler—Aquarium Cooler—Peltier—YouTube," dated Jun. 6, 2013; https://www.youtube.com/watch?v=muePI_F9rIU.

Discussion entitled "Fermentation Control with Peltier Cooler?" posted Apr. 19, 2010.

Discussion entitled "Peltier Cooling of Water Reservoir," posted Mar. 21, 2012.

Discussion entitled "Peltier soda cooler builds," posted Jul. 25, 2012.

"The Peltier-Powered Self-Cooling Coolie," Popular Mechanics, dated Sep. 10, 2014.

"Thermoelectric Modules/LairdTech," dated Apr. 10, 2018, discussing the history of the Peltier Effect.

* cited by examiner

METHOD AND INSTALLATION FOR PREPARING A DRINK, PARTICULARLY WINE, FOR TASTING

RELATED APPLICATIONS

This application is a National Phase Application of PCT/FR2014/051679, filed on Jul. 1, 2014, which in turn claims the benefit of priority from French Patent Application No. 13 56492 filed on Jul. 3, 2013, the entirety of which are incorporated herein by reference.

BACKGROUND

Field of the Invention

The present invention relates to a method and an installation for preparing a beverage, in particular a wine, for tasting.

The invention relates more particularly to an installation including a liquid flow pipe equipped with at least one feed inlet for feeding in beverage for preparation, and with at least one dispensing outlet for dispensing the prepared beverage.

Description of Related Art

It is known that, in order to be fully appreciated, wines must be served under appropriate conditions. In particular, the optimum temperature is defined. It depends on the nature and on the origin of the wine. Certain white wines should be served very chilled (generally at about 7° C.), whereas certain red wines should be served at a temperature slightly lower than room temperature (and generally at about 18° C.) In addition, many wines, in particular red wines when they are young, improve by being slightly oxidized by being exposed to air. Traditionally, such oxidation takes place by decanting the wine. Such constraints regarding preparing the wine before drinking it require considerable preparation in advance by wine lovers. The bottle(s) need to be stored in a place at the correct temperature for several hours in advance, and, for wines that need to be oxidized, the bottle(s) either need to be uncorked 6 to 12 hours in advance, or, for young wines that are still a little hard, the bottle needs to be poured into a decanter for about one hour before the wine is tasted. Such anticipation, which is necessary for tasting a good wine, is tedious.

Numerous techniques exist for aerating a wine, i.e. for letting it breathe. For such aeration, there is the traditional decanter, but many other systems have also been proposed, in particular in the for of pouring spouts that are of a variety of degrees of complexity, such as the spout in Patent GB 1894 08 229 that describes a design that can be found in many commercially available products today (the "Soirée" pourer, the "Trudeau" aerator disclosed in USD 624,358, the "Fanmara" pourer disclosed in U.S. Pat. No. 8,251,352, etc.). There is also a technique whereby air is injected into the bottle, either by a manual piston (U.S. Pat. No. 5,154,112), or by a motor-driven pump (U.S. Pat. No. 4,494,452). Independent aerators, through which the wine passes and becomes oxygenated, have been proposed, either with a "rain" system through which the wine falls (U.S. Pat. No. 5,713,263), or by a fountain effect (U.S. Pat. No. 5,293,912 or U.S. Pat. No. 7,299,743), or else by means of the conventional Venturi effect (U.S. Pat. No. 7,614,614, WO 2012/112774, US 2012/156338).

In addition, numerous systems for bringing wine to the correct temperature exist and are described, for example, in U.S. Pat. No. 4,518,104, U.S. Pat. No. 5,501,077, U.S. Pat. No. 4,723,688, or WO 2011/030339.

There are also devices for serving the wine by the glass while preserving the remainder of the contents of the bottle from oxidation, such as in U.S. Pat. No. 3,883,043, U.S. Pat. No. 4,473,174, U.S. Pat. No. 4,706,847, WO2010/029381, and EP 1 352 873.

Document WO-A-2013/042131 discloses an installation that has cooling means for cooling a bottle, which means are in the form of a refrigerated enclosure inside which the bottle is stored, and aeration means for aerating a fraction of the contents of the bottle, which means are disposed on a pipe for emptying the bottle. That configuration makes it impossible to bring wine to the correct temperature in a short time.

None of those devices makes it possible, in the same installation and in a short time, to aerate the wine and to bring it to the correct temperature.

OBJECTS AND SUMMARY

An object of the invention is thus to propose an installation that makes it possible, in a short time, to prepare a wine for tasting.

Another object of the invention is to propose an installation that is compact and reliable, and that requires little maintenance.

To this end, the invention provides an installation for preparing a beverage, in particular a wine, for tasting, said installation including a liquid flow pipe equipped with at least one feed inlet for feeding in beverage for preparation, and with at least one dispensing outlet for dispensing the prepared beverage, said installation being characterized in that said pipe is provided with Peltier-effect cooling and/or heating means and with aeration means for cooling and/or heating and for aerating the inside of the pipe, the two means being disposed along the pipe over different segments of said pipe that are referred to respectively as "the cooling and/or heating segment" and as "the aeration segment".

By means of the presence, on the same liquid flow pipe, of not only cooling and/or heating means for cooling and/or heating the beverage for preparation, but also aeration means, it is possible, in a short time, to obtain a beverage that is ready for tasting.

The fact the cooling and/or heating means for cooling and/or heating the beverage for preparation are disposed in series on the same pipe results in a large number of advantages.

The use of Peltier-effect cooling and/or heating means results in it being possible for the operator to choose a heating operation or a cooling operation merely by reversing the polarity.

Preferably, said pipe has at least one closure member disposed between the cooling and/or heating segment and the aeration segment.

Preferably, the cooling and/or heating segment is disposed upstream from the aeration segment.

The closure member makes it possible, firstly, to retain the beverage in the heating and/or cooling segment or portion of the flow pipe that is disposed between the inlet of the pipe and the closure member, for a time that is a function of the cooling or heating operation to be performed, and secondly to facilitate the subsequent aeration operation, in particular when the aeration means are of the Venturi type, as described below.

In addition, performing the operation of cooling the wine prior to the operation of aerating it facilitates said aeration operation due to the solubility properties of the gas, which is air in this example, this solubility increasing with increasing temperature.

Preferably, the pipe is equipped with at least one liquid recycling loop.

In a first embodiment, in the in-use configuration, the pipe is a vertical pipe configured for flow by gravity, with the feed inlet of the pipe being disposed at a level higher than the level of the dispensing outlet of said pipe.

This configuration generates compactness and simplicity of installation.

In a second embodiment, said installation is equipped with forced liquid flow means for forcing liquid to flow inside said pipe.

Preferably, the aeration means are of the Venturi type and comprise a constriction in said pipe, and at least one air intake inlet transverse to the longitudinal axis of the pipe and opening out into said constriction.

Preferably, said at least one air intake inlet is equipped with a closure member that preferably has at least three positions.

In a first embodiment of the invention, the drive means for moving the closure member from one position to another are controlled manually.

In a second embodiment of the invention, the installation includes data input supply means for supplying one or more item(s) of data representative of the desired aeration rate, and control means for controlling the aeration means as a function of the at least one item of data representative of the aeration rate supplied by said means for supplying one or more items of data.

It is also possible to cause the quantity of air introduced into the wine to vary, as a function of the characteristics of the wine.

Preferably, the installation includes means for measuring the temperature in the cooling and/or heating segment of said pipe, means for supplying one or more items of data representative of a setpoint temperature, and means for controlling the cooling and/or heating means as a function of the measured temperature and of the at least one item of data representative of the setpoint temperature supplied by the means for supplying one or more items of data.

The control means are configured to control the magnitude and/or the power of the current fed to the cooling/or heating means as a function of the setpoint temperature and of the measured temperature.

Preferably, the installation includes means for controlling the cooling and/or heating means as a function of the measured temperature and of the at least one item of data representative of the setpoint temperature supplied by the means for supplying one or more items of data.

The closure member, which is caused to open as a function of the measured temperature and of the at least one item of data representative of the setpoint temperature supplied by the means for supplying one or more items of data, may be caused to close either automatically, after a predetermined open period corresponding to a predetermined delivery of liquid, or manually, as a function of the filling of a receptacle, such as a glass, placed at the outlet of said pipe.

Preferably, the means for supplying the one or more items of data representative of the setpoint temperature comprise data acquisition means and/or a data input interface or "human-machine interface" (HMI), and/or a memory for storing one or more predefined items of data. The data input interface may comprise a remote control and/or a touch-sensitive screen and/or a keyboard, and/or merely a control button.

Preferably, the means for supplying the one or more items of data representative of the desired aeration rate comprise data acquisition means and/or a data input interface or "human-machine interface" (HMI), and/or a memory for storing one or more predefined items of data. The data input interface may comprise a remote control and/or a touch-sensitive screen and/or a keyboard, and/or merely a control button.

Preferably, the data acquisition means comprise a Radio-Frequency identification (RFID) chip reader incorporated into the installation, and suitable for reading the data contained in a chip associated with the container of the beverage for preparation, or a bar-code reader which is suitable for reading a bar code associated with the container of the beverage for preparation.

Preferably, the memory for storing data contains data in the form of a chart (name of wine, tasting temperature corresponding to the setpoint temperature, and, optionally, aeration rate), so that the user can, merely by inserting the container of the beverage into the installation, indirectly supply a setpoint temperature and, optionally, an aeration rate.

In the manual version, the data is supplied manually to the installation by the operator via the human-machine interface on the basis of data indicated on the container of the beverage.

Preferably, the installation includes cleaning means for cleaning the flow pipe, said cleaning means comprising at least one reservoir for storing a cleaning fluid and that is connectable to said pipe.

Preferably, the flow pipe is equipped at the inlet with at least one hollow needle that acts as a perforator suitable for perforating the container of the beverage for preparation.

The flow pipe is preferably also equipped, in the vicinity of its beverage feed inlet, with an air pipe that ends in the form of a perforator end-piece in such a manner as to make it possible, in parallel, for the container of beverage to be perforated with two perforations, with a view to enabling the container to empty into said pipe.

In an embodiment, the air pipe surrounds the hollow needle acting as a perforator.

Preferably, both said feed pipe and also the cooling and/or heating means and the aeration means are incorporated, into a structure equipped at its base with a removable reservoir underlying a horizontal grating on which the receptacle, such as a glass, for collecting the prepared beverage can be placed, the reservoir and its grating being positioned vertically in register with the outlet of said pipe.

Preferably, the pipe is equipped with at least one liquid recycling loop.

The invention further provides a method of preparing a beverage, in particular a wine, for tasting, said method being characterized in that it includes a step consisting in heating and/or cooling the beverage by Peltier effect and in aerating the beverage by causing said beverage for preparation to flow inside a flow pipe equipped with cooling and/or heating means and with aeration means for cooling and/or heating and for aerating the inside the pipe that are disposed in series along said pipe, and in that the method further includes a step consisting in collecting said beverage as prepared at the outlet of said pipe.

In an implementation of the method, after said beverage has been collected, the pipe is subjected to a washing step.

BRIEF DESCRIPTION OF THE DRAWINGS

The invention can be well understood on reading the following description of embodiments given with reference to the accompanying drawings, in which.

DETAILED DESCRIPTION

Figure 1:
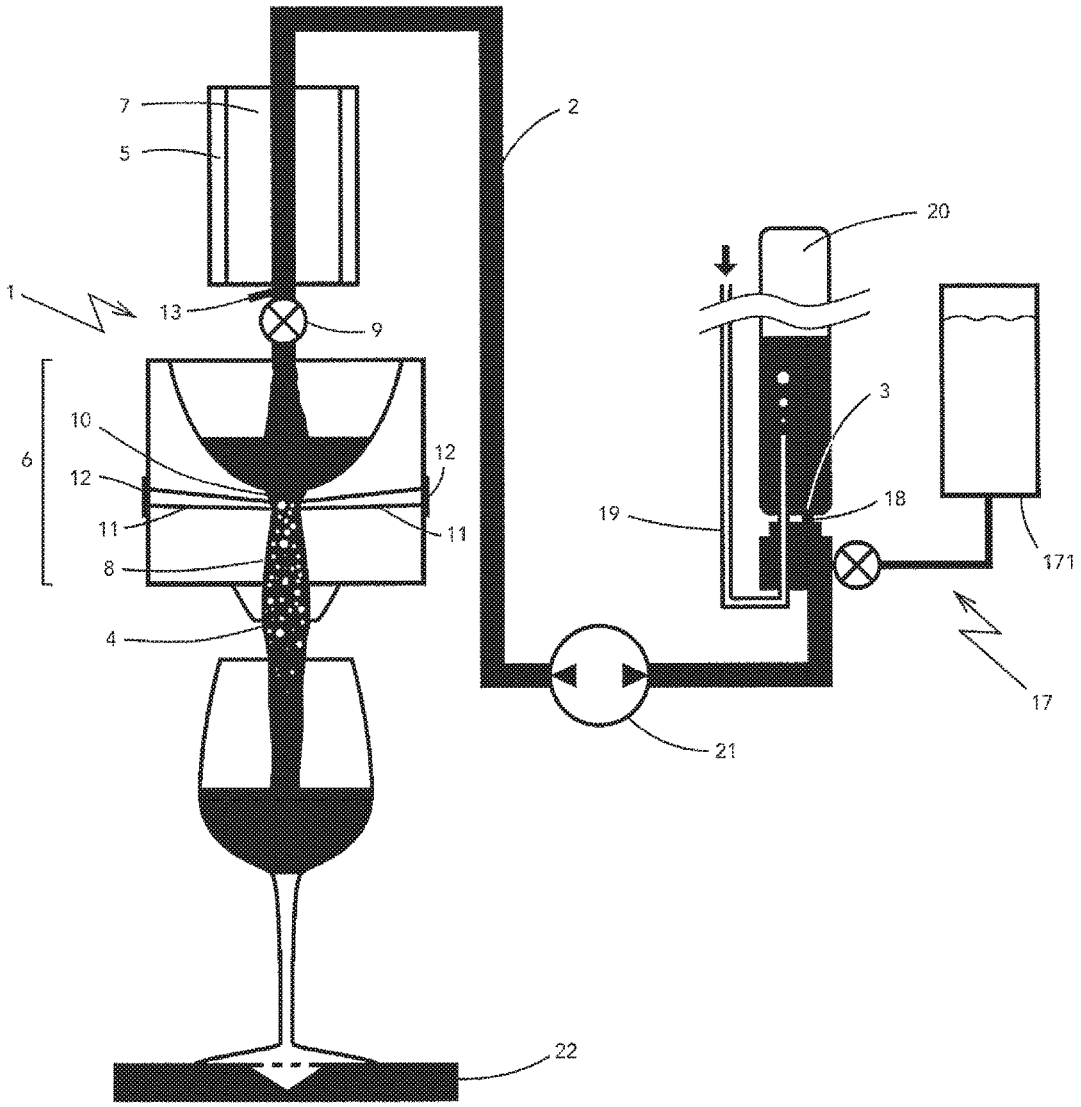
FIG. 1 is a simplified diagrammatic section view of an installation of the invention, with the control means not being shown.

As indicated above, the invention relates to an installation for preparing a beverage, in particular a wine, for tasting.

This installation includes a liquid flow pipe 2 equipped with at least one feed inlet 3 for feeding in a beverage for preparation, and at least one dispensing outlet. 4 for dispensing the prepared beverage. This dispensing outlet 4 may be a single outlet, as shown in FIG. 1, or a multiple outlet, as shown in FIG. 2.

In a manner characteristic of the invention, said flow pipe 2 is provided with Peltier-effect cooling and/or heating means 5 and with aeration means 6 for cooling and/or heating and for aerating the inside of the pipe 2, the two means being disposed along the pipe over different segments of said pipe that are referred to respectively as the "cooling and/or heating segment or portion 7" and as the "aeration segment 8" of said pipe.

Figure 2:
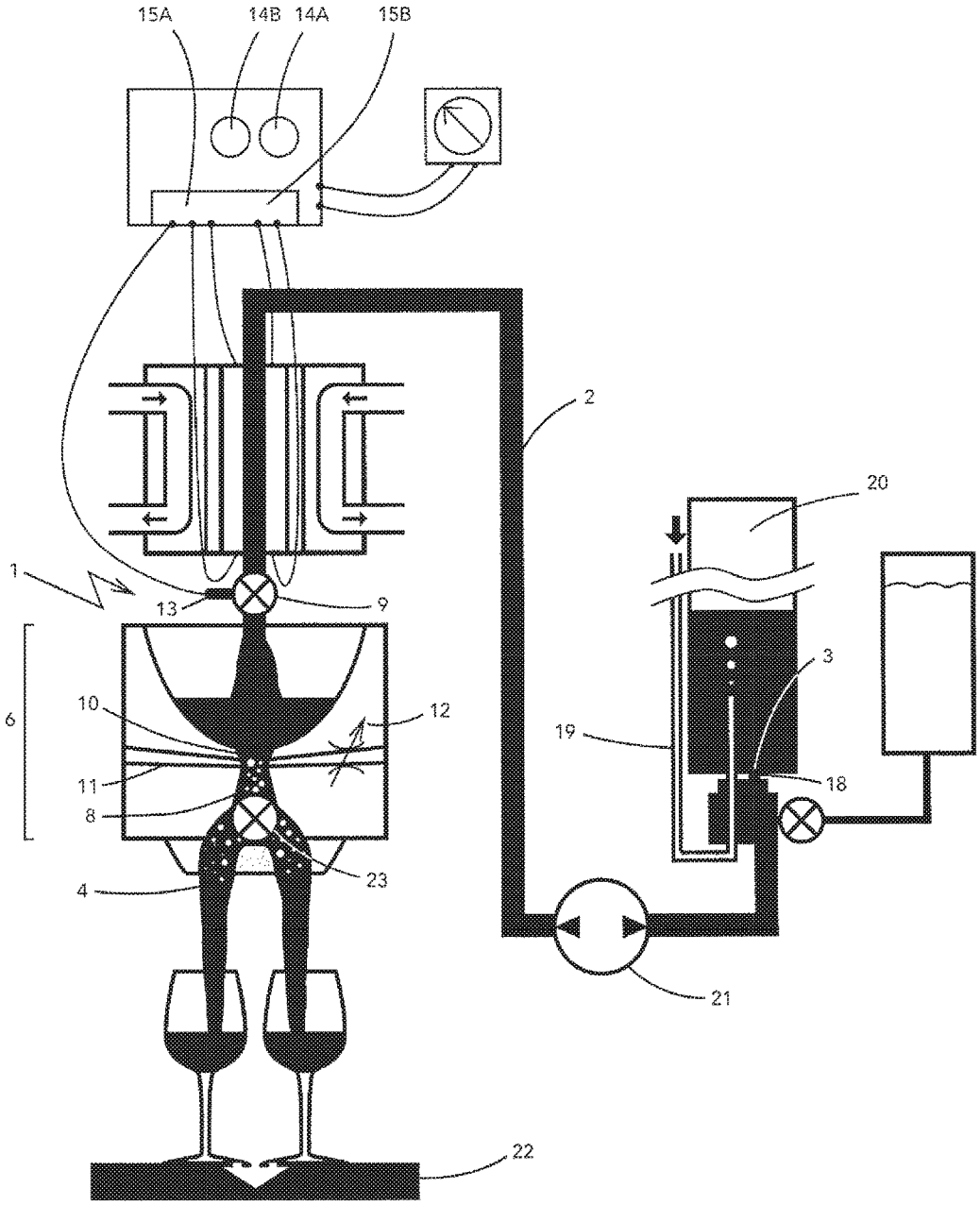
FIG. 2 is a simplified diagrammatic section view of an installation of the invention, with the cooling and/or heating means and the control means being shown in more detailed manner.
Figure 3:
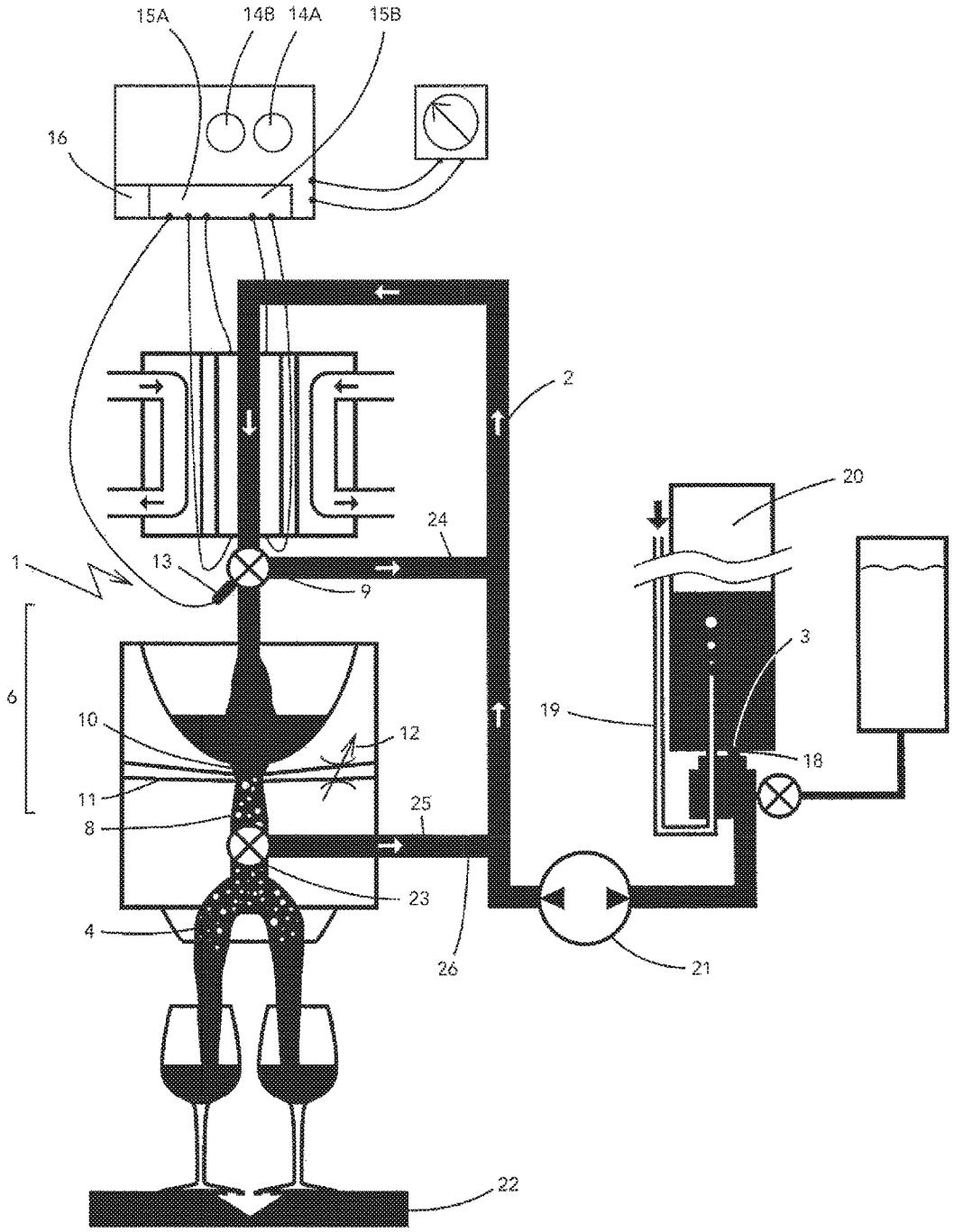
FIG. 3 is a simplified diagrammatic section view of an installation of the invention equipped with liquid recycling loops.

In the example shown in FIGS. 1 to 3, the installation is equipped with forced flow means 12 for forcing liquid to flow inside said pipe 2.

These forced flow means 21 are pumping means that are preferably formed by a peristaltic pump. In this embodiment, the feed inlet 3 of the pipe may be disposed at a level that is lower than or at the same level as the level of the dispensing outlet 4 of said pipe 2.

Figure 4:
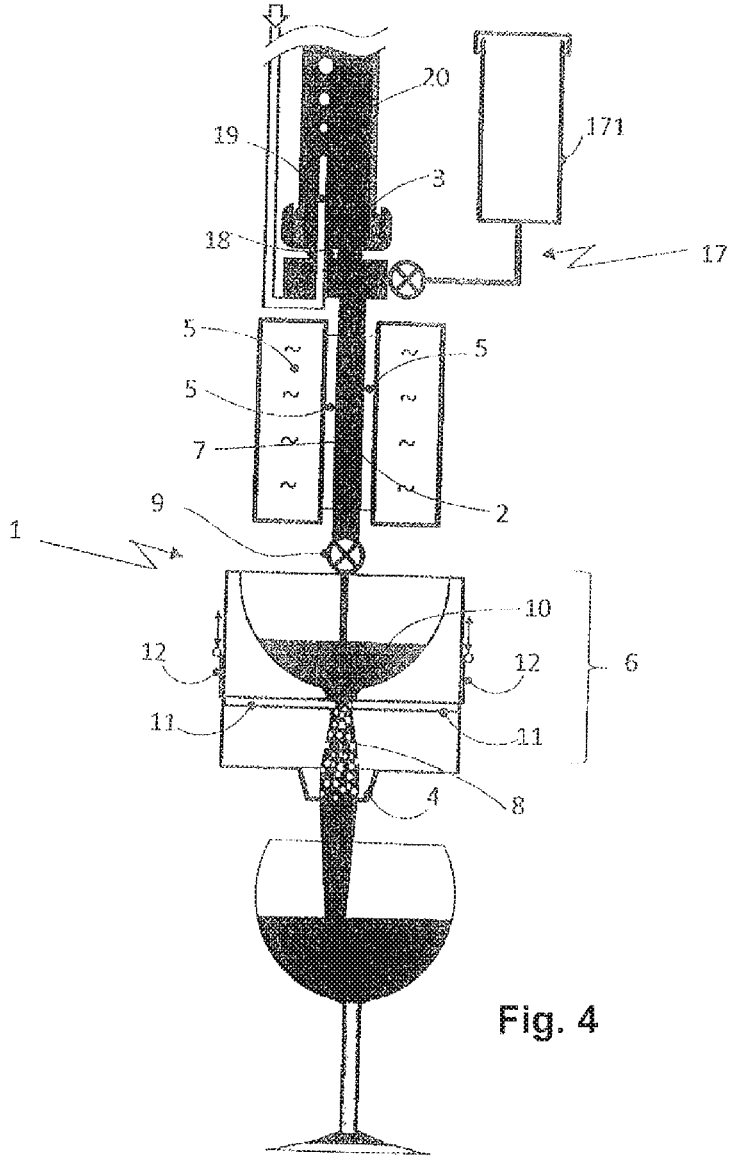
FIG. 4 is a simplified section view of another embodiment of an installation of the invention.

In the example shown in FIG. 4, the flow pipe 2 and the cooling and/or heating means 5 and the aeration means are incorporated into a column-type structure, inside which the flow pipe 2 extends substantially vertically, with the feed inlet 3 of the pipe disposed at a level higher than the level of the dispensing outlet 4 of said pipe so as to enable the beverage for preparation to flow down by gravity inside said pipe.

Independently of the embodiment chosen, the beverage feed inlet 3 of the pipe extends in a storage zone for storing the container of the beverage 20 for preparation. This container may be a bottle, a tube, a metered-dose dispenser, or some other type of container. Said container may be stored statically in said zone, as shown. Said storage zone may, in a variant, have an actuator suitable for automatically and progressively inclining the container, so as to enable it to be emptied.

Generally, the container is stored with its opening facing downwards so as to enable the container to be emptied by gravity. In this example, said container is in the form of a bottle stored with the opening facing downwards. Said opening is closed by a cap or stopper that has a thin wall and that is perforatable.

For this purpose, the flow pipe 2 is equipped at its inlet 3 with at least one hollow needle 18 acting as a perforator and suitable for perforating the container of the beverage for preparation.

The installation further includes air feed means for feeding air into said container so as to enable it to empty.

For this purpose, the installation shown further includes a second needle 19, one end of which opens out to the surrounding air or is connectable to forced air feed means, and the other end of which opens out into the storage zone in which the container of the beverage for preparation is stored. Thus, when the container is inserted cap-first into the storage zone, its cap comes to be pierced by the two needles, one of which is designed to feed beverage to the flow pipe 2 and the other of which is designed to take air into the container in order to enable it to empty. In a variant, the air feed means for feeding air to the container may be formed by an air feed pipe surrounding the hollow needle 18. The air feed pipe may have one end connected to the surrounding air or connectable to forced air feed means, and, its "perforating" other end suitable for opening out into the storage zone in which the container of the beverage for preparation is stored.

Following on from its inlet, the flow pipe 2 may have a cooling and/or heating segment for cooling and/or heating the beverage for preparation. To this end, said segment or portion of pipe is flanked by Peltier-effect cooling and/or heating means 5. These cooling and/or heating means 5 comprise at least one Peltier-effect cell. In the example shown, two Peltier-effect cells or modules are provided that are disposed on two facing portions of the outside surface of the pipe.

These two Peltier-effect cells or modules, which are generally identical from one cell to another, are in the form of rectangles, each coupled via its "cold" face to the outside surface of the side or peripheral wall defining the flow pipe 2 via a thermal contact, such as a thermal adhesive or brazing.

Each of these cells or modules has a "hot" opposite face coupled, e.g. by adhesive, to a heat exchange block for exchanging at with the environment surrounding the installation.

Said heat exchange blocks may be coupled thermally to the ambient air, either by air convection (possibly stimulated by a fan), or by a flow of fluid coming from and returning to a reservoir that itself acts a thermal buffer and as a heat exchanger with the ambient air.

Figure 5:
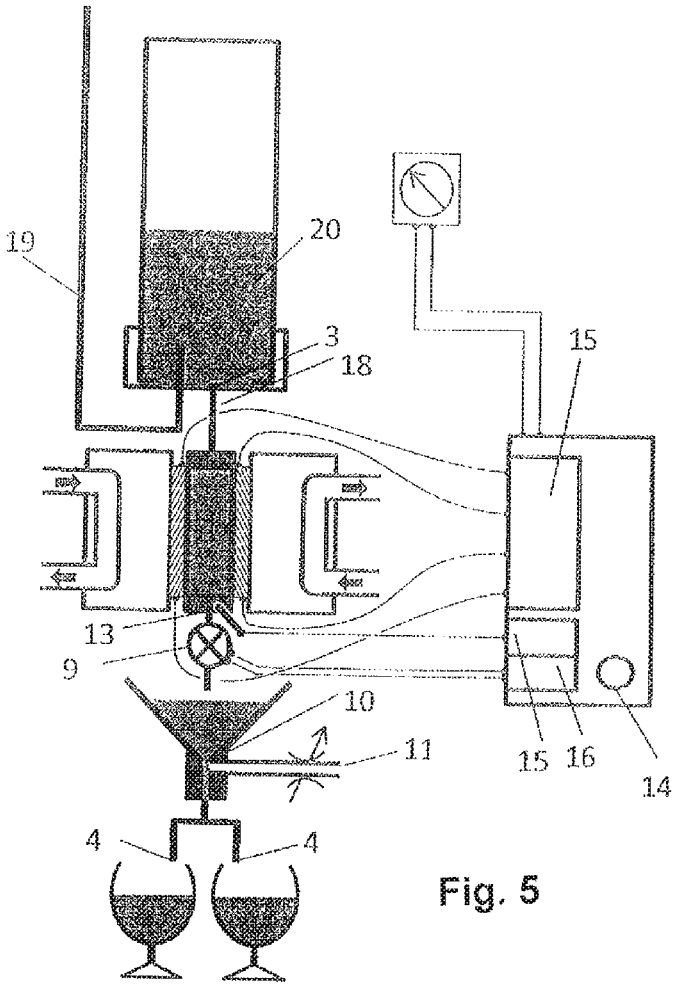
FIG. 5 is a simplified diagrammatic view of a variant of FIG. 4.

This second embodiment is shown in FIG. 5. The Peltier-effect cells or modules are fed with direct current (DC) and, to this end, are connected to an electronic control box that houses the control means 15A for controlling the cooling and/or heating means 5, operation of which is described in detail below.

It should be noted that the use of a Peltier-effect cell or module makes it possible firstly for the beverage flowing in the pipe to be cooled and/or heated rapidly, and secondly for the hot and cold cells or modules to be reversed merely by reversing the polarity.

In order to optimize the cooling and/or heating and in order to prevent air pockets from forming, the cooling and/or heating segment of the pipe is preferably provided with at least one vent. This vent may be closable by means of a closure member having controlled opening/closure. Said event may open out into a buffer reservoir.

The aeration means 6 are of the Venturi type and comprise a constriction 10 in the pipe 2 and at least one air intake inlet 11 transverse to the longitudinal axis of the pipe 2 and opening out into said constriction 10.

In the example shown, the aeration means 6 have two air inlets 11, transverse to the longitudinal axis of the pipe 2, and disposed in diametrically opposite manner on said pipe, said two inlets opening out into the constriction 10.

Naturally, other aeration means, such as, for example a moving ramp that can intercept the flow of wine at various heights and force it to spread over a sheet of area that is of variable magnitude, or a system in which air is injected into the wine by an adjustable-speed pump, could have been considered, but aeration means 6 of the Venturi type remain preferred because they are simple to implement and it is possible for them to operate very well in combination with the cooling and/or heating means 5.

In the installation as shown, the pipe 2 is provided with a closure member 9 that is disposed between the cooling and/or heating segment and the aeration segment 8, and the cooling and/or heating segment 7 is disposed upstream from the aeration segment 8.

Thus, the beverage accumulates in the cooling and/or heating segment, where it can be stored until it reaches the correct temperature.

Once the temperature is reached, the closure member 9 is opened and the beverage penetrates into the aeration segment. The Venturi effect sucks in the air, which mixes with the beverage.

In a variant, said closure member 9 may be omitted when the performance of the cooling and/or heating means 5 so permit.

Preferably, each of the air intake inlets 11 is equipped with a closure member 12 having at least three positions.

In the example shown, said closure member 12 is formed by a sliding flap that obstructs the air intake inlet with which it is associated to a greater or lesser extent as a function of its position. The sliding flap may be actuated manually or automatically.

Visual identification means for visually identifying each position of the closure member, such as graduations or the like may be provided in the vicinity of said closure member so as to facilitate adjustment, when the adjustment is manual.

Each position corresponds to a degree of aeration of the wine. The aeration segment of the pipe is extended by the dispensing outlet 4 of the flow pipe 2. This outlet may be a single outlet or a multiple outlet, and in this example it is a double outlet as shown in FIG. 2.

Generally, this outlet is disposed vertically in register with and above a grating forming the top of the reservoir 22. The grating disposed horizontally serves as a tray for supporting a receptacle, such as a glass, for collecting the prepared beverage. The associated reservoir 22 makes it possible to collect the surplus prepared beverage and prevents the surrounding environment from being soiled in the event of overflow. This reservoir 22 also serves to collect cleaning fluid when means for cleaning the flow pipe 2 are present.

In order to enable the beverage to be brought to an optimum temperature, the installation includes measurement means 13 for measuring the temperature in the cooling and/or heating segment 7 of said pipe, means 14A for supplying one or more items of data representative, of a setpoint temperature, and means 15A for controlling the cooling and/or heating means 5, as a function of the measured temperature and of the at least one item of data representative of the setpoint temperature supplied by the means 14A for supplying one or more items of data.

In this example, the measurement means 13 are formed merely by a temperature probe placed in the cooling and/or heating segment of the pipe 2. The means for supplying the one or more items of data representative of the setpoint temperature comprise data acquisition means and/or a data input interface or "human-machine interface" (HMI), and/or a memory for storing predefined items of data.

In the example shown, the means 14A for supplying one or more items of data are formed merely by a graduated potentiometer knob. Naturally, this knob could be replaced or supplemented with a digital-input keyboard, a display with two up/down buttons making it possible to raise or to lower the setpoint temperature. It is also possible to consider using a bar code reader or an RFID reader that reads information on the wall of the bottle and defines the setpoint temperature.

The control means 15A for controlling the cooling and/or heating means 5 comprise an electronic and/or computer unit and an associated working memory.

When it is specified that the control means are configured to perform an action, what is meant is that the microprocessor includes instructions for performing the action on the basis of the measured temperature and of the setpoint temperature.

The control means are thus configured to control feeding current to the cooling and/or heating means 5. Generally, the electronic and/or computer unit of said control means compares the setpoint temperature with the measured temperature. As a function of that comparison, the electronic and/or computer unit adjusts the current in the Peltier modules. If the measured temperature is greater than the setpoint temperature, the control unit sends current so as to cool the segment of pipe. That current may be regulated. For example, its amplitude is proportional to the temperature difference between the measured temperature and the setpoint temperature.

The wine can be too cold relative to the setpoint temperature. An example might come from a user who keeps bottles in a cool cellar and who wishes to taste a heady red wine that should be served at 18° C. Since operation of the Peltier elements is reversible, it suffices to reverse the sign of the DC relative to the assumption that the wine is to be cooled, so that the Peltier elements warm the beverage.

The installation further includes control means 16 for controlling the closure means 9 for closing off said pipe, as a function of at least the measured temperature and of the at least one item of data representative of the setpoint temperature supplied by said means 14 for supplying one or more items of data. In this example, the closure member 9 is caused to open when the setpoint temperature is reached. The time for which it is open is a function of the quantity of wine to be delivered.

These control means 16 may be common to the control means 15 for controlling the cooling and/or heating means 5.

Finally, the installation includes means 14B for supplying one or more item(s) of data representative of the desired aeration rate and control means 15B for controlling the aeration means 6 as a function of the at least one item of data representative of the aeration rate supplied by said means 145 for supplying one or more items of data.

The means 145 for supplying one or more items of data may be of the same type as those described above for the cooling and/or heating means 5. Similarly, the control means may be at least partially common.

Finally, the installation includes means 17 for cleaning the flow pipe 2. These cleaning means 17 include at least one reservoir 171 for storing a cleaning fluid, which reservoir is connectable to said pipe 2. In this example, this storage reservoir 171 is a removable reservoir shown close to the input of the flow pipe 2 and connected to said pipe via a closure member. The storage reservoir 171 of the cleaning means 17 is preferably equipped with pump means for pumping its contents, which pump means may be common to or distinct from the pump means 21 equipping the pipe 2 when said pump means 21 are present. The cleaning means 17 further include a reservoir 22 for collecting the cleaning fluid, which reservoir is disposed vertically in register with and below the dispensing outlet 4 of the flow pipe 2 as described above.

In the example shown, the cleaning means 17 include a reservoir 171 for storing a cleaning fluid, which reservoir is connectable to said pipe 2 via a closable link.

In the example shown in FIG. 3, the pipe 2 is equipped with liquid recycling loops 24, 25, 26.

In the example shown, the first recycling loop 24 is disposed at the cooling and/or heating segment 7, and the recycling can take place by means of the closure member 9 that is disposed between the cooling and/or heating segment 7 and the aeration segment 8, said closure member 9 being, for example a 3-port valve 3.

A second recycling loop 25 is provided at the aeration segment 8. To this end, a closure member 23 is provided at the downstream end or outlet of the aeration segment 8, and the liquid can, from said closure member 23, be brought back by the recycling loop to the inlet of the aeration segment 8. In this embodiment, a third recycling loop 26 that starts in common with the second recycling loop 25 makes it possible to bring the liquid back to the inlet of the cooling and/or heating segment 7.

Such an installation operates as follows: The beverage for preparation contained inside a container is brought by means of said container to the storage zone of the installation, with the container positioned upside down, so that the thin stopper closing said container can be perforated by the needles 18 and 19 while the container is being put in place in said storage zone.

The fluid flow pipe 2 can then be fed with beverage from said container.

The user supplies a setpoint temperature to the installation, in particular, in this example, by actuating the setpoint temperature setting button.

The measurement probe measures the temperature of the beverage contained in the flow pipe 2, at the cooling and heating segment 7. As a function of the result of the comparison, current is fed to the Peltier-effect heating and/or cooling means to generate either cooling or heating of said beverage.

Once the setpoint temperature has been reached, the closure member disposed between the cooling and/or heating segment and the aeration segment is caused to open if said closure member 9 is present.

Independently of whether the embodiment is an embodiment with the closure member 9 or an embodiment without the closure member 9, the beverage then flows through the aeration segment 8 where it is charged with air if necessary, as a function of the aeration rate selected by the user. To make that selection, the user has, prior to that, set the positions of the closure means of said air intake inlets 11 of said segment.

The beverage heated and/or cooled and aerated in this way reaches a receptacle such as a glass, disposed at the outlet of the flow pipe 2.

This operation can be performed in a few minutes so that, within a very short time, the user can have a beverage for tasting. In most cases, for red wines, the operation lasts less than one minute.

In certain embodiments in which the cooling and/or heating segment of the pipe can hold only a fraction of the capacity of a wine glass, it can be necessary to repeat the operation several times for the same glass.

In the embodiments in which recycling loops are provided, it can be necessary to cause the liquid to be recycled at one or each pipe segment 7, 8. This recycling can be controlled by means of the control unit for controlling the closure member 9 between the cooling and/or heating segment 7 and the aeration segment 8, and the closure member 23 disposed at the outlet of the aeration segment 8.

The forced liquid flow means 21 may also be controlled by means of said control unit.

The invention claimed is:

1. An installation for preparing a beverage for tasting, said installation comprising:

a liquid flow pipe equipped with at least one feed inlet for feeding in beverage for preparation, and at least one dispensing outlet for dispensing the prepared beverage, wherein said pipe is provided with a Peltier-effect cooling and/or heating element and with an aeration element for cooling and/or heating and for aerating the inside of the pipe, the two elements being disposed along the pipe over different segments of said pipe that are referred to respectively as a cooling and/or heating segment and as an aeration segment.

2. The installation according to claim 1, wherein said pipe has at least one closure member disposed between the cooling and/or heating segment and the aeration segment.

3. The installation according to claim 1, wherein the cooling and/or heating segment is disposed upstream from the aeration segment.

4. The installation according to claim 1, wherein, in an in-use configuration, the pipe is a vertical pipe configured for flow by gravity, with the feed inlet of the pipe being disposed at a level higher than the level of the dispensing outlet of said pipe.

5. The installation according to claim 1, wherein the aeration element are of the Venturi type and comprise a constriction in said pipe, and at least one air intake inlet transverse to the longitudinal axis of the pipe and opening out into said constriction.

6. The installation according to claim 5, wherein said at least one air intake inlet is equipped with a closure member that preferably has at least three positions.

7. The installation according to claim 2, wherein said installation includes means for measuring the temperature in the cooling and/or heating segment of said pipe, means for supplying one or more items of data representative of a setpoint temperature, and means for controlling the cooling and/or heating means as a function of the measured temperature and of the at least one item of data representative of the setpoint temperature supplied by the means for supplying one or more items of data.

8. The installation according to claim 7, wherein said installation further includes control means for controlling the closure means for closing off said pipe, as a function of at least the measured temperature and of the at least one item of data representative of the setpoint temperature supplied by said means for supplying one or more items of data.

9. The installation according to claim 7, wherein the means for supplying the one or more items of data representative of the setpoint temperature comprise data acquisition means and/or a data input interface or human-machine interface (HMI), and/or a memory for storing one or more predefined items of data.

10. The installation according to claim 1, wherein said installation includes cleaning means for cleaning the flow pipe, said cleaning means comprising at least one reservoir for storing a cleaning fluid and that is connectable to said pipe.

11. The installation according to claim 1, wherein the flow pipe is equipped at the inlet with at least one hollow needle that acts as a perforator suitable for perforating a container of the beverage for preparation.

12. The installation according to claim 1, wherein said installation includes means for supplying one or more item(s) of data representative of the desired aeration rate, and control means for controlling the aeration means as a function of the at least one item of data representative of the aeration rate supplied by said means for supplying one or more items of data.

13. The installation according to claim 1, wherein said installation is equipped with forced liquid flow means for forcing liquid to flow inside said pipe.

14. The installation according to claim 1, wherein the pipe is equipped with at least one liquid recycling loop.

* * * * *